US012747090B2

(12) United States Patent
Jasper et al.

(10) Patent No.: US 12,747,090 B2
(45) Date of Patent: Sep. 29, 2026

(54) PROTECTIVE CAP, SYSTEM WITH DISPENSING HEAD AND PROTECTIVE CAP, AND DISPENSER

(71) Applicant: APTAR DORTMUND GMBH, Dortmund (DE)

(72) Inventors: Bernhard Jasper, Waltrop (DE); Guido Burmann, Ruethen (DE)

(73) Assignee: APTAR DORTMUND GMBH, Dortmund (DE)

( * ) Notice: Subject to any disclaimer, the term of this patent is extended or adjusted under 35 U.S.C. 154(b) by 140 days.

(21) Appl. No.: 18/714,403

(22) PCT Filed: Dec. 7, 2022

(86) PCT No.: PCT/EP2022/084776

§ 371 (c)(1),
(2) Date: May 29, 2024

(87) PCT Pub. No.: WO2023/104877

PCT Pub. Date: Jun. 15, 2023

(65) Prior Publication Data

US 2025/0256909 A1 Aug. 14, 2025

(30) Foreign Application Priority Data

Dec. 8, 2021 (DE) ..... 20 2021 003 722.5

(51) Int. Cl.
*B65D 83/40* (2006.01)

(52) U.S. Cl.
CPC ..... *B65D 83/40* (2013.01)

(58) Field of Classification Search
CPC ..... B65D 83/40
See application file for complete search history.

(56) References Cited

U.S. PATENT DOCUMENTS 2,704,621 A * 3/1955 Soffer ..... B65D 83/48 222/536
3,129,839 A * 4/1964 Grimsley ..... B65D 83/40 222/182

(Continued)

FOREIGN PATENT DOCUMENTS

DE 2528238 A1 1/1977
EP 0482625 A1 4/1992

(Continued)

OTHER PUBLICATIONS

International Search for Report for International Application No. PCT/EP2022/084776, mailed Apr. 6, 2023.

(Continued)

*Primary Examiner* — Donnell A Long
(74) *Attorney, Agent, or Firm* — Jason H. Vick; Amped IP LLC

(57) ABSTRACT

A protective cap for a dispensing head of a dispenser for dispensing a fluid is proposed. The protective cap is attachable to the dispensing head or dispenser such that the protective cap at least substantially completely surrounds the dispensing head. The protective cap has a side wall and an open end, the side wall defining a cavity for receiving the dispensing head. Preferably, the protective cap has an end portion at the open end which is radially widened relative to the side wall. Alternatively or additionally, the protective cap comprises a latching device for latchingly attaching the protective cap to the dispensing head and/or dispenser and additionally comprises an anti-tilt means for preventing tilting of the protective cap.

18 Claims, 4 Drawing Sheets

(56) References Cited

U.S. PATENT DOCUMENTS

| | | | | | |
|---|---|---|---|---|---|
| 3,397,822 | A * | 8/1968 | Peters | B65D 83/20 | 222/402.13 |
| 3,927,796 | A * | 12/1975 | Whitehouse | B65D 83/40 | 220/793 |
| 3,955,716 | A | 5/1976 | Goncalves | | |
| 2009/0045223 | A1 | 2/2009 | Laidler et al. | | |
| 2009/0188918 | A1 * | 7/2009 | Robbins, III | B65D 51/24 | 220/212 |

FOREIGN PATENT DOCUMENTS

| | | | |
|---|---|---|---|
| JP | H1191817 | A | 4/1999 |
| JP | 2001-130659 | A | 5/2001 |
| JP | 2020-033051 | A | 3/2020 |
| WO | WO 2013/008016 | A1 | 1/2013 |

OTHER PUBLICATIONS

Written Opinion for Report for International Application No. PCT/EP2022/084776, mailed Apr. 6, 2023.

* cited by examiner

PROTECTIVE CAP, SYSTEM WITH DISPENSING HEAD AND PROTECTIVE CAP, AND DISPENSER

CROSS-REFERENCE TO RELATED APPLICATIONS

The present application is a national stage application under 35 U.S.C. 371 of PCT Application No. PCT/EP2022/084776, filed 7 Dec. 2022, which designated the United States, which PCT application claimed the benefit of German Patent Application No. 20 2021 003 722.5, filed 8 Dec. 2021, each of which are incorporated herein by reference in their entirety.

BACKGROUND

The present invention relates to a protective cap for a dispensing head of a dispenser for dispensing a fluid, a system comprising a dispensing head for dispensing a fluid and a protective cap, and a dispenser comprising a container for receiving a fluid, a dispensing head and a protective cap.

Generally, protective caps for a dispensing head are known from the prior art.

A dispensing head is used for dispensing a fluid from a container, in particular from a container of a dispenser. A dispenser is in particular a device comprising a container for receiving the fluid and a dispensing head for dispensing the fluid.

The fluid is preferably a cosmetic product, for example a deodorant, a perfume, a shaving foam, a shampoo, a shower gel, a cream, makeup or the like.

By means of a dispensing head, the fluid can be dispensed in various forms, for example as a liquid, paste, gel, foam or spray. Accordingly, the dispenser is typically formed as a type of can such as a spray can.

A protective cap is typically attached to the dispensing head and/or the dispenser, for example, by slipping or snapping on. The protective cap serves to prevent unintentional actuation of the dispensing head and/or unintentional dispensing of the fluid with the dispensing head.

However, there is often the problem that the protective cap can be detached from the dispensing head all too easily or that it detaches from the dispensing head unintentionally. This problem occurs more frequently when dispensers equipped with a dispensing head and a protective cap are not delivered to the retail trade in larger quantities, for example on pallets, via traditional distribution channels and sold to the end customer there, but are sold individually directly to the customer, for example via the Internet or e-commerce. In this type of direct sales to the customer, the dispensers are often sent directly to the customer individually in a package, wherein there is an increased risk of the protective cap detaching from the dispenser or the dispensing head, so that the dispensing head is actuated unintentionally and/or a product escapes from the dispensing head or dispenser.

SUMMARY

Therefore, it is an object of the present invention to prevent unintentional detaching of a protective cap attached to a dispensing head and/or dispenser.

The above object is solved by a protective cap, a system or a dispenser as disclosed herein.

A protective cap according to the proposal for a dispensing head of a dispenser for dispensing a fluid is attachable to the dispensing head and/or dispenser such that the protective cap at least substantially completely surrounds the dispensing head. Further, the protective cap has a side wall and an open end, the side wall defining a cavity for receiving the dispensing head.

According to a first aspect of the present invention, the protective cap has an end portion at the open end, the end portion being offset outwardly from the side wall. In particular, the inner surface of the end portion is offset outwardly from the side wall and/or the inner surface thereof. By this, an improved attachment to or fit on the dispensing head and/or dispenser can be achieved, such that inadvertent detachment of the protective cap from the dispensing head and/or dispenser is prevented.

According to a further aspect, which may also be implemented independently, the protective cap, in particular the side wall thereof, comprises a latching device for latchingly attaching the protective cap to the dispensing head and/or dispenser. In addition to the latching device, the protective cap according to this further aspect comprises an anti-tilt means for preventing tilting of the protective cap. This prevents unintentional detachment of the protective cap from the dispensing head. Indeed, it has been shown that a latching device alone, as is often used, does not provide satisfactory protection against tilting of the protective cap on the dispenser or dispensing head, and especially an initial tilting of the protective cap is often the cause of an unintentional detachment of the protective cap.

Preferably, the anti-tilt means comprises or is formed by the end portion already mentioned.

The end portion or the inner surface thereof is preferably has a greater distance from a central axis of the protective cap than the side wall or the inner surface thereof. This provides an improved fit of the protective cap on the dispenser or dispensing head so that it does not come off easily.

The end portion and/or the side wall is/are preferably cylindrical, sleeve-like and/or ring-like. This makes the protective cap easy and inexpensive to manufacture. Furthermore, it can be easily removed from the dispensing head for actuation thereof, if desired.

Preferably, the protective cap comprises a shoulder between the side wall and the end portion. In particular, the shoulder is a radial shoulder and/or the shoulder forms or comprises a surface extending in a radial direction. This enables a defined and tight fit of the protective cap on the dispensing head.

The length of the end portion is preferably at least 3 mm, more preferably at least 5 mm, and/or at most 20 mm, more preferably at most 10 mm. This is conducive to effective anti-tilt protection.

The length of the protective cap is preferably at least 2 times, more preferably at least 3 times, particularly preferably at least 4 times, and/or at most 10 times, more preferably at most 8 times, particularly preferably at most 6 times, the length of the end portion. In particular, the "length" of the side wall or of the end portion is understood to be the extension of the side wall or of the end portion along a central axis or longitudinal axis of the protective cap and/or of the dispenser. The aforementioned length ratios effectively prevent tilting or detachment of the protective cap.

Preferably, the protective cap, in particular the side wall, comprises a latching device for latchingly attaching the protective cap to the dispensing head and/or dispenser. Preferably, the latching device comprises or consists of one or more latching elements. The length of the end portion is preferably at least 1 times, more preferably at least 2 times, the distance between the latching device or the latching element(s) and a lower edge of the side wall or the shoulder which preferably forms or defines the lower edge of the side wall. This can effectively prevent tilting of the protective cap or inadvertent release of the protective cap.

When the protective cap is attached to the dispensing head and/or dispenser, the overlap between the end portion and a lower portion of the dispensing head and/or an upper end of the container is preferably at least 3 mm, more preferably at least 5 mm, and/or at most 20 mm, more preferably at most 10 mm. This effectively prevents the protective cap from tilting.

Preferably, the end portion surrounds or engages a lower part of the dispensing head and/or an upper end of a container of the dispenser when the protective cap is attached to the dispensing head and/or dispenser. This effectively prevents the protective cap from tilting.

According to another aspect which may also be implemented independently, the present invention relates to a system comprising a dispensing head for dispensing a fluid and a protective cap, preferably wherein the protective cap is configured as described above and/or explained in more detail below.

According to another aspect which can also be implemented independently, the present invention relates to a dispenser comprising a container for receiving a fluid and a system comprising a dispensing head and a protective cap. In other words, according to this aspect, the present invention relates to a dispenser comprising a container for receiving a fluid, a dispensing head for dispensing the fluid from the container and a protective cap for the dispensing head.

The above-mentioned aspects and features, as well as further aspects and features resulting from the claims and the following description, may be realized independently of each other and in any combination.

Further advantages, features, characteristics and aspects of the present invention will be apparent from the claims and the following description of a preferred embodiment with reference to the drawings.

DETAILED DESCRIPTION

In the figures, some of which are not to scale and are only schematic, the same reference signs are used for the same or similar parts, wherein corresponding or comparable properties and advantages can be achieved, even if a repeated description is omitted.

Figure 1:
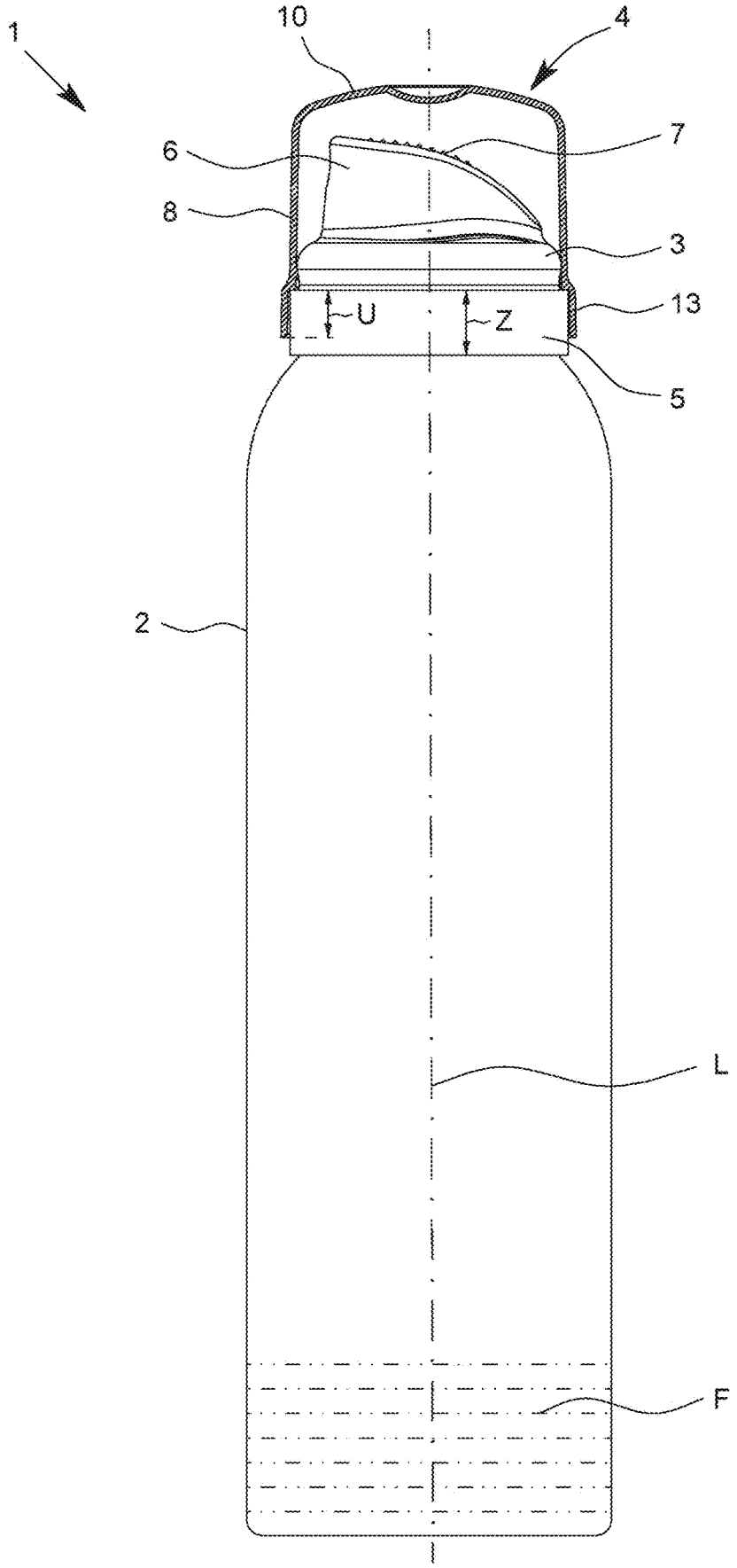
FIG. 1 is a schematic view of a dispenser with a dispensing head and a protective cap according to the proposal.

FIG. 1 shows a schematic representation of a dispenser 1. The dispenser 1 comprises a container 2 for receiving a fluid F schematically indicated, and a dispensing head 3 for dispensing the fluid F from the container 2.

The fluid F is preferably a cosmetic product, a medical product, a hygiene and/or cleaning product or the like, for example a deodorant, a perfume, a cream, a shaving foam, a shower gel, a shampoo, a hair gel, a hair spray, a bathroom cleaner, a dishwashing liquid, an oven cleaner or the like.

The fluid F is preferably contained in the dispenser 1 or container 2. Via the dispensing head 3, the fluid F can be conveyed from the container 2 and/or dispensed from the dispenser 1 and/or to a user not shown.

Furthermore, a protective cap 4 according to the proposal is shown in FIG. 1. Preferably, the dispenser 1 comprises the protective cap 4, wherein the protective cap 4 forms an independent aspect of the present invention and can also be realized separately.

The container 2 and the dispensing head 3 are shown in FIG. 1 in a side view, while the protective cap 4 is shown in a sectional view.

In the representation according to FIG. 1, the protective cap 4 is attached to the dispensing head 3 and thus in particular to the dispenser 1. In contrast to the illustration in FIG. 1, the protective cap 4 can also be attached to the container 2 or another part of the dispenser 1 instead of to the dispensing head 3.

The protective cap 4 is preferably removable from the dispensing head 3 and/or container 2 and/or dispenser 1.

The dispensing head 3 and the protective cap 4 preferably form a system, in particular a system of two parts corresponding to each other. In particular, the protective cap 4 and the dispensing head 3 correspond to each other or the protective cap 4 and the dispensing head 3 are matched to each other in such a way that the protective cap 4 can be fastened, in particular in a latching manner, to the dispensing head 3, in particular to the lower part 5.

The illustration of the dispenser 1 in FIG. 1 is purely exemplary. In particular, both the container 2 and the dispensing head 3 can take a variety of shapes. For example, the container 2 need not be elongate in shape, but may also be much shorter than shown in FIG. 1. The dispensing head 3 may also assume any external shape.

Figure 2:
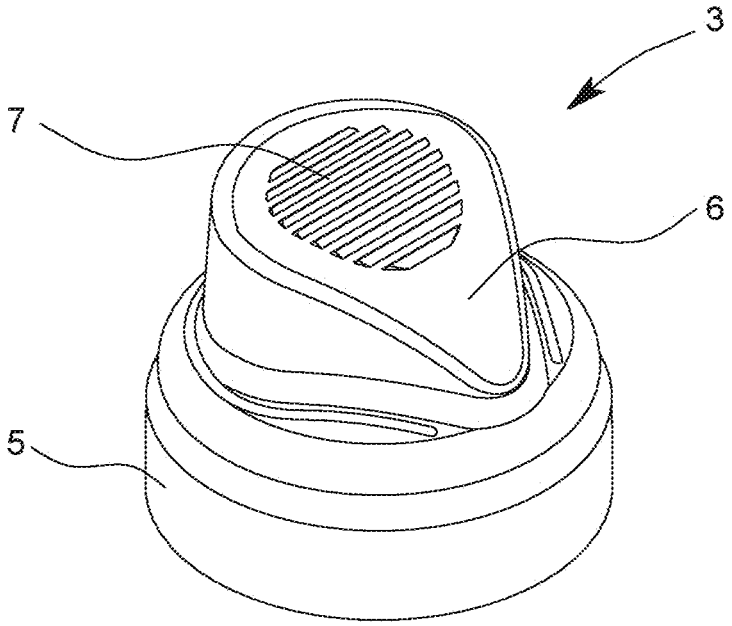
FIG. 2 is a perspective view of a dispensing head.

In FIG. 2, the dispensing head 3 is shown in a perspective view.

The dispensing head 3 is preferably actuatable, for example depressible, by a user not shown, so that by actuating the dispensing head 3 the fluid F is conveyed from the container 2 and dispensed from the dispensing head 3 and/or to the user. The dispensing head 3 may, for example, be configured to dispense the fluid F as a fluid or liquid, gel, foam, cream or spray.

The dispensing head 3 preferably comprises a lower part 5. The lower part 5 is preferably fixedly and/or immovably attached or attachable or connected or connectable to the container 2.

Further, the dispensing head 3 preferably comprises an upper part 6. The upper part 6 is preferably movable, in particular relative to the lower part 5 and/or container 2. In particular, the upper part 6 has an actuating section 7 and/or the upper part 6 is movable in the direction of the lower part 5 and/or container 2, in particular can be pressed down, so that the fluid F can be dispensed from the dispensing head 3 by actuating or pressing down the upper part 6. For this purpose, the dispensing head 3, in particular the upper part 6, has a correspondingly designed dispensing opening for dispensing the fluid F, which is not shown in greater detail in the figures. If required, the dispensing opening can also be designed as or have a nozzle or the like.

In the illustrative example, the lower part 5 is a part or section of the dispensing head 3. In particular, the lower part 5 is non-detachably connected to the upper part 6 and/or detachably connectable or connected to the dispenser 1 and/or container 2. However, this is not mandatory.

It may also be provided that the lower part 5 forms a part or a section, in particular an upper end, of the container 2, for example a collar or the like. Preferably, in this case, the dispensing head 3 and/or the upper part 6 is inserted or insertable into the upper end of the container 2, for example the collar. In particular, in this case, it may be provided that the lower part 5 is non-detachably connected to the container 2 and/or the upper part 6 is detachably connected to or attached to the lower part 5.

In other words, the lower part 5 may thus in particular constitute or be formed by an upper end of the container 2. In this case, the protective cap 4 is accordingly preferably attachable to the container 2, in particular to the upper end of the container 2.

The upper end of the container 2 is in particular the end of the container 2 shown in FIG. 1 above or facing the dispensing head 3 and/or connectable to the dispensing head 3. The upper end of the container 2 is in particular the end facing away from a base and/or a standing surface of the container 2.

In particular, the protective cap 4 is shown in more detail in FIGS. 3 to 8.

Figure 3:
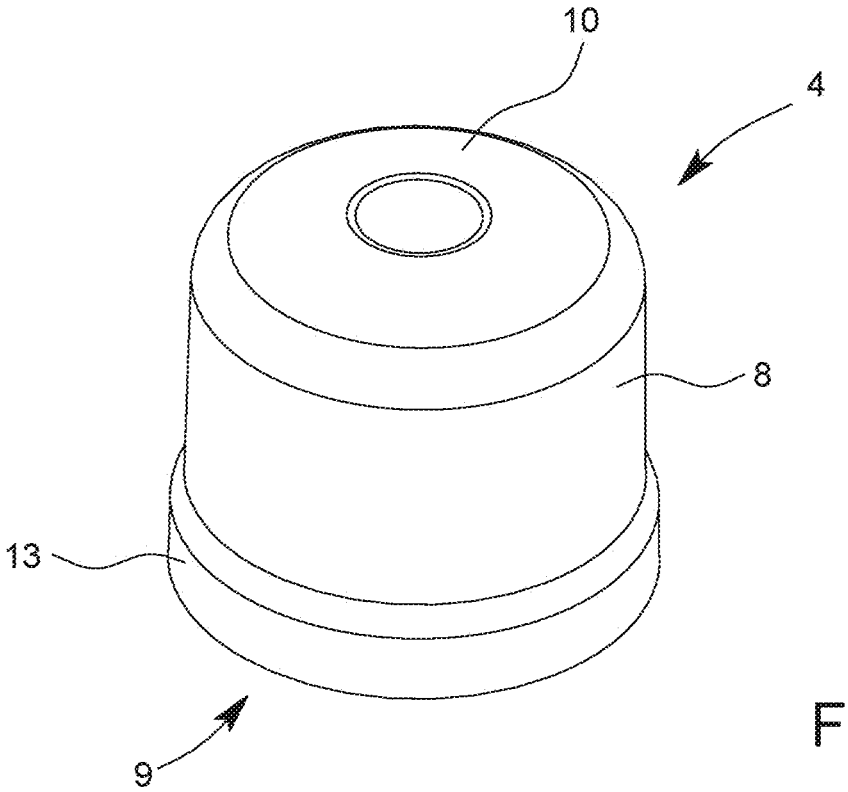
FIG. 3 is a perspective view of a protective cap according to the proposal.
Figure 4:
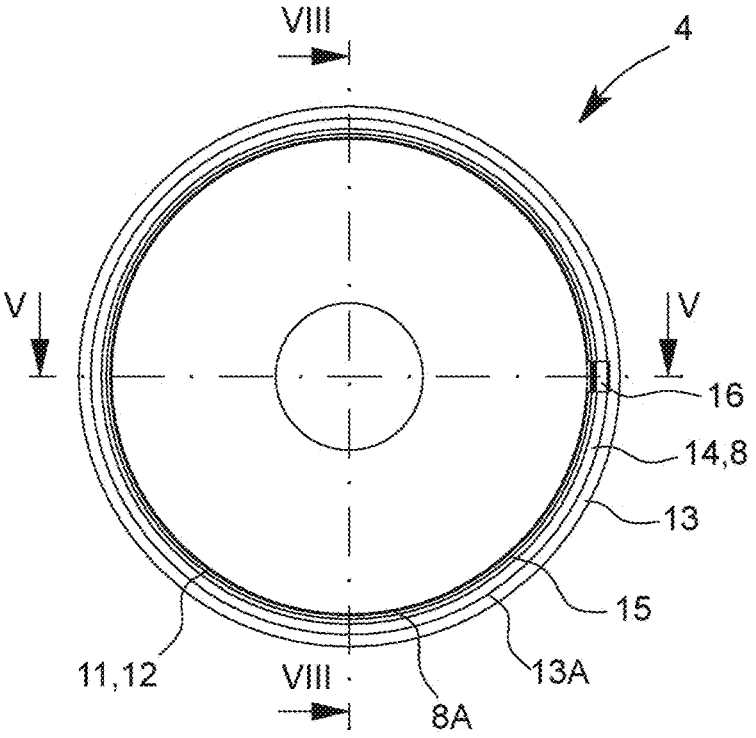
FIG. 4 is a plan view of the protective cap according to FIG. 3 from the direction of the open end of the protective cap.
Figure 5:
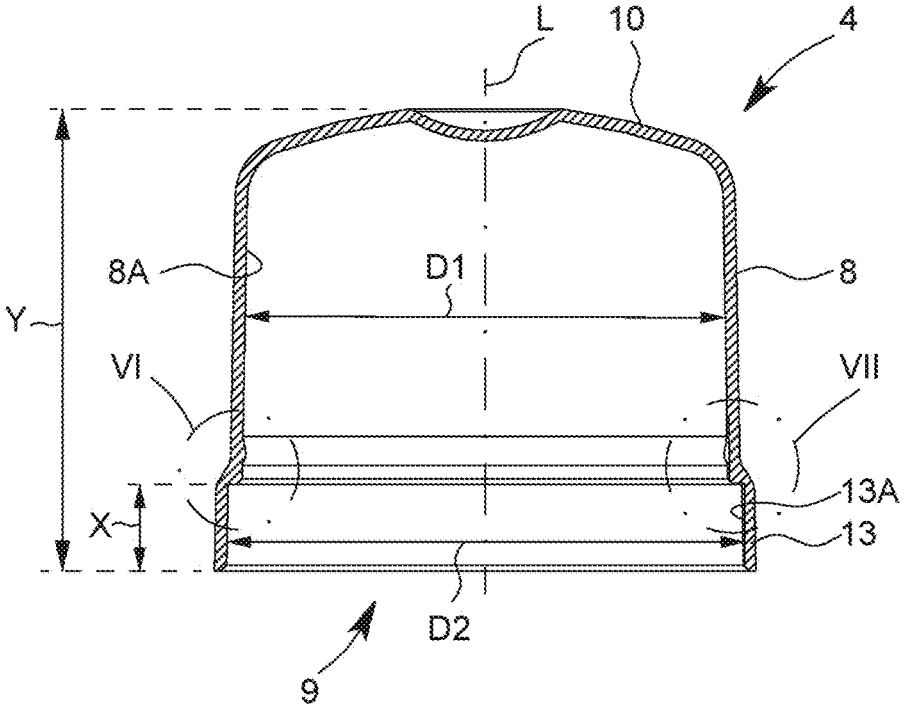
FIG. 5 is a section through the protective cap along the line V-V of FIG. 4.
Figure 6:
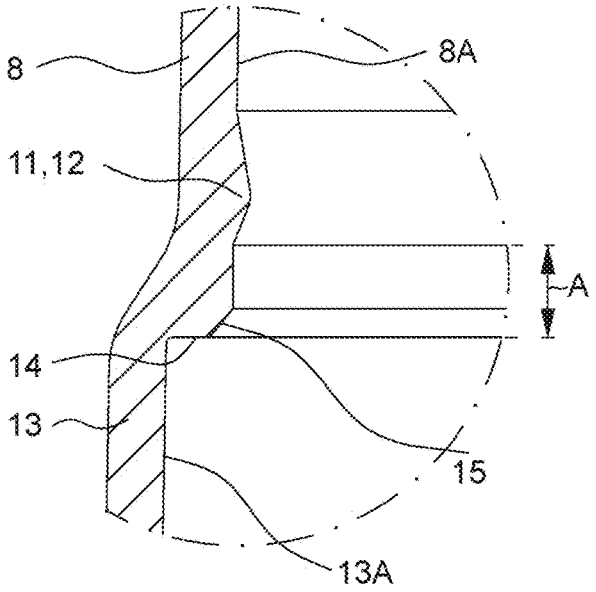
FIG. 6 is an enlargement of subarea VI of FIG. 5.
Figure 7:
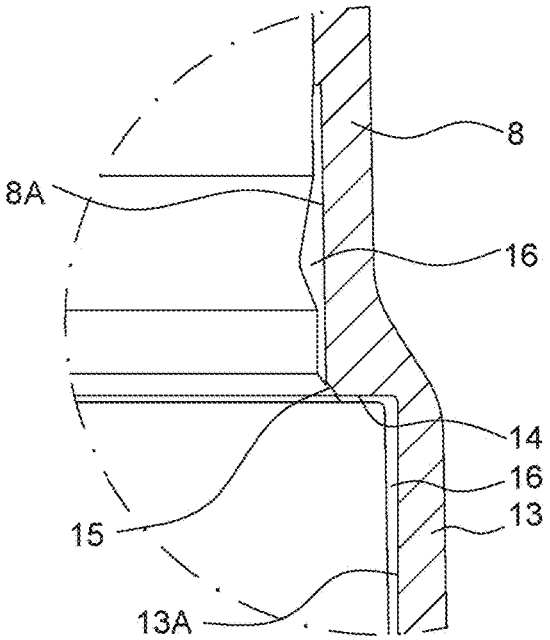
FIG. 7 is an enlargement of subarea VII of FIG. 5.
Figure 8:
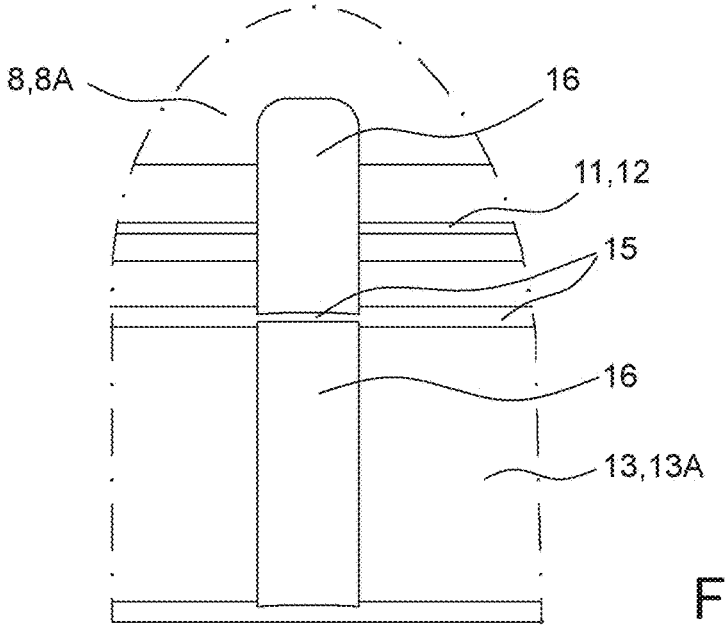
FIG. 8 is a section of a cut through the protective cap along line VIII-VIII of FIG. 4.

FIG. 3 shows the protective cap 4 in a perspective view. FIG. 4 shows the protective cap 4 in a plan view from below, in particular so that the interior of the protective cap 4 is visible. FIG. 5 shows the protective cap 4 in a sectional view through the axis V according to FIG. 4. In FIGS. 6 and 7, the sub-regions VI and VII according to FIG. 5 are shown enlarged. In FIG. 8, a sectional view along line VIII-VIII according to FIG. 4 is shown enlarged.

The protective cap 4 is preferably made of a plastic material.

The protective cap 4 preferably has a longitudinal axis or axis of symmetry or central axis L. The central axis L is preferably also a longitudinal axis or axis of symmetry or central axis of the dispensing head 3, the container 2 and/or the dispenser 1. The central axis L is shown schematically in FIGS. 1 and 5.

In particular, the protective cap 4 is configured to prevent unintentional actuation of the dispensing head 3 and/or unintentional dispensing of the fluid F from the dispenser 1 or dispensing head 3.

The protective cap 4 is adapted to at least substantially completely surround the dispensing head 3. When the protective cap 4 is attached to the dispensing head 3 or dispenser 1, it preferably surrounds the dispensing head 3 at least substantially completely, at least laterally or in a radial direction, and/or prevents actuation of the dispensing head 3.

The protective cap 4 has a side wall 8 and an open end 9. The side wall 8 preferably has an inner surface 8A.

Particularly preferably, the protective cap 4 also has a closed end 10. Preferably, the closed end 10 is formed by a lid of the protective cap 4, which is in particular connected to the side wall 8 and/or extends transversely to the side wall 8. However, instead of the closed end 10, the protective cap 4 may comprise another open end, although this is less preferred.

The side wall 8 defines, possibly together with the closed end 10, a cavity for receiving the dispensing head 3. The cavity is in particular formed by the interior of the protective cap 4 and/or enclosed or laterally delimited by the side wall 8. When the protective cap 4 is attached to the dispenser 1 or dispensing head 3, the dispensing head 3 is preferably arranged or received in the cavity.

The side wall 8 is preferably at least substantially cylindrical or hollow cylindrical. In particular, the side wall 8 has a preferably at least substantially cylindrical inner surface 8A. However, other basic shapes are also possible, for example a basic shape of the side wall 8 or inner surface 8A which is oval or elliptical or polygonal in cross-section perpendicular to the central axis L.

Preferably, the protective cap 4, in particular the side wall 8, has a latching device 11 for latchingly attaching the protective cap 4 to the dispensing head 3 and/or dispenser 1, in particular container 2.

The latching device 11 preferably has or consists of one or more latching elements 12. The latching element or elements 12 are preferably formed on the inner surface 8A of the protective cap 4 or of the side wall 8. In particular, the latching element(s) 12 is/are each formed by an elevation and/or latching lug which is particularly preferably arranged on the inner surface 8A of the side wall 8. However, other solutions are also possible here. In particular, the latching element(s) 12 may also be formed by recesses.

The latching device 11 is not mandatory, but purely optional.

In the illustrative example, the protective cap 4 and/or the latching device 11 comprises exactly one latching element 12 which is ring-like and/or is designed to surround/encircle the protective cap 4. In the illustrative example, the latching device 11 and/or the latching element 12 is formed to almost completely surround/encircle the protective cap 4.

Preferably, the protective cap 4 comprises an end portion 13. Preferably, the end portion 13 is formed and/or arranged at the open end 9 and/or the end portion 13 adjoins the side wall 8 in the direction of the open end 9. Preferably, the end portion 13 has an inner surface 13A.

Preferably, the end portion 13 and the side wall 8 are integrally formed or formed in one piece, in particular injection-molded.

The end portion 13 and/or the side wall 8 and/or their inner surfaces 13A, 8A is/are preferably cylindrical or hollow cylindrical, sleeve-like and/or ring-like in shape, as shown in particular in the figures. In principle, however, other shapes are also possible. For example, the end portion 13 and/or the side wall 8 and/or their inner surfaces 13A, 8A can also be oval, elliptical and/or polygonal, for example hexagonal or octagonal, in cross-section, in particular thus in a section transverse or orthogonal to the central axis L. The end portion 13 may also be conical in shape, in particular in order to achieve a tighter fit on the lower part 5 or the upper end of the container 2.

The end portion 13 and/or its inner surface 13A is preferably offset (radially) outwardly with respect to the side wall 8 or its inner surface 8A.

The term "radial" refers in particular to the central axis L. Accordingly, a radial direction or extension is in particular a direction or extension radial or orthogonal to the central axis L.

By the fact that the end portion 13 is "offset (radially) outwardly" relative to the side wall 8, it is to be understood in particular that the end portion 13 has (in the radial direction) larger (inner) dimensions than the side wall 8, and/or two radially opposite points on the inner surface 13A of the end portion 13 have a greater distance than two radially opposite points on the inner surface 8A of the side wall 8.

In other words, it is particularly preferred that the end portion 13 and/or its inner surface 13A has a greater distance from the central axis L of the protective cap 4 or dispenser 1 than the side wall 8 or its inner surface 8A. The distance from the central axis is understood to be the smallest distance between a point on the inner surface 13A, 8A and the central axis L.

In the case where the end portion 13 and the side wall 8 or the inner surfaces 13A, 8A thereof are each at least substantially cylindrical or are each at least substantially cylindrical or circular in cross-section, the feature that the end portion 13 is offset (radially) outwardly relative to the side wall 8 in particular means that the internal diameter D2 of the end portion 13, i.e. the distance between two radially opposite points on the inner surface 13A of the end portion 13, is greater than the internal diameter D1 of the side wall 8, i.e. the distance between two radially opposite points on the inner surface 8A of the side wall 8 (D2>D1).

If the end portion 13 and the side wall 8 or their inner surfaces 13A, 8A are each at least substantially cylindrical or circular in cross-section, the distance of the end portion 13 or the side wall 8 from the central axis L is in particular in each case half the respective inner diameter D1, D2.

Particularly preferably, therefore, the protective cap 4 has two cylindrical sections with different internal diameters D1, D2 or distances from the central axis L, namely, in the illustrative example, the cylindrical side wall 8 with the internal diameter D1 and the cylindrical end portion 13 with the internal diameter D2.

If the end portion 13 and the side wall 8 or their inner surfaces 13A, 8A are each at least substantially hexagonal or orthogonal, the feature that the end portion 13 is offset (radially) outwardly relative to the side wall 8 in particular means that the distance between two radially opposite sides on the inner surface 13A of the end portion 13 is greater than the distance between two radially opposite sides of the inner surface 8A of the side wall 8.

When the end portion 13 and the side wall 8 or their inner surfaces 13A, 8A are elliptical in cross-section, the elliptical cross-sections are respectively defined by a small and a large semi-axis, each of which can be understood as an inner diameter of the corresponding inner surface 8A, 13A. In this case, the feature that the end portion 13 is offset (radially) outwardly with respect to the side wall 8 in particular means that the small semi-axis of the end portion 13 is greater than the small semi-axis of the side wall 8. In this case, the respective small semi-axis is in particular the distance of the end portion 13 or of the side wall 8 from the central axis L.

In particular, the end portion 13 or its inner surface 13A encloses or delimits a larger (cross-sectional) area, in particular an area orthogonal to the central axis L, than the side wall 8 or its inner surface 8A.

The foregoing explanations regarding the radial outward offset of the end portion 13 with respect to the side wall 8 refer in particular respectively to the inner surfaces 13A, 8A and inner diameters D2, D1 of the end portion 13 and of the side wall 8.

In the embodiment shown in the figures, the outer diameter of the end portion 13 is also larger than the outer diameter of the side wall 8, but this is not mandatory. It is also possible for the side wall 8 and the end portion 13 to have different inner diameters D1, D2 but the same outer diameter, for example by the side wall 8 being thicker than the end portion 13, so that on the outside of the protective cap 4 the side wall 8 and the end portion 13 seamlessly merge into one another or adjoin one another, in particular so that the outer surfaces of the side wall 8 and the end portion 13 together form a cylindrical surface or lateral surface of a cylinder or the like. Also in this case, the end portion 13 is offset (radially) outwardly relative to the side wall 8.

Preferably, the protective cap 4 has a shoulder 14 between the side wall 8 or inner surface 8A and the end portion 13 or inner surface 13A thereof. In particular, the shoulder 14 is a radial shoulder or the shoulder 14 extends radially. Preferably, the shoulder 14 extends perpendicularly to the side wall 8 or the inner surface 8A thereof and/or the end portion 13 or the inner surface 13A thereof.

The lower part 5 and/or upper end of the container 2 preferably forms a stop, in particular an axial stop, for the protective cap 4, in particular for the shoulder 14.

Preferably, the shoulder 14 connects the end portion 13 or its inner surface 13A to the side wall 8 or its inner surface 8A.

In the illustrative example, the inner surface of the protective cap 4 has an inclined surface 15 between the shoulder 14 and the side wall 8 or its inner surface 8A. However, this is not mandatory. Preferably, the inclined surface 15 connects the side wall 8 or its inner surface 8A to the shoulder 14 or the end portion 13 or its inner surface 13A.

The length X of the end portion 13 is preferably at least 3 mm, more preferably at least 5 mm and/or at most 20 mm, preferably at most 10 mm. In this context, the length X of the end portion 13 is understood to be, in particular, the extension of the end portion 13 in the longitudinal direction parallel to the central axis L. Particularly preferably, the length X of the end portion 13 is the distance between the shoulder 14 and the open end 9 of the protective cap 4 and/or the lower edge of the end portion 13, as schematically indicated in FIG. 5. In particular, the lower edge of the end portion 13 is the edge of the end portion 13 facing away from the side wall 8.

The length Y of the protective cap 4 is preferably at least 2 times, more preferably at least 3 times, particularly preferably at least 4 times and/or at most 10 times, more preferably at most 8 times, particularly preferably at most 6 times, the length X of the end portion 13. The length Y of the protective cap 4 is in particular the extension of the protective cap 4 along the central axis L, as schematically indicated in FIG. 5.

Preferably, the length Z of the lower part 5, in particular, therefore, the extension of the lower part 5 along the central axis L, is greater than the length X of the end portion 13. This is shown in particular in the figures. However, other solutions are also possible here.

For example, the length X of the end portion 13 may also be equal to or greater than the length Z of the lower part 5. In the embodiment shown in the figures, in which the length Z of the lower part 5 is greater than the length X of the end portion 13, preferably the lower part 5 is still partially visible when the protective cap 4 is attached to the dispensing head 3 and/or the end portion 13 does not completely cover the lower part 5.

Preferably, when the length X of the end portion 13 is equal to or greater than the length Z of the lower part 5, the lower part 5 is no longer visible when the protective cap 4 is attached to the dispensing head 3 and/or the end portion 13 completely covers/hides the lower part 5. In particular, in this case, the end portion 13 may extend up to the container 2 or, if the protective cap 4 is fixed to the dispensing head 3 or dispenser 1, it may rest on the container 2 or contact the container 2.

Preferably, the end portion 13 and the lower part 5 overlap when the protective cap 4 is attached to the dispensing head 3, as shown in particular in FIG. 1. Preferably, the overlap U between the end portion 13 and the lower part 5 and/or an upper end of the container 2 is at least 3 mm, more preferably at least 5 mm, and/or at most 20 mm, more preferably at most 10 mm.

The length X of the end portion 13 is preferably at least 50%, more preferably at least 75%, particularly preferably at least 100%, of the length of the lower part 5 and/or the upper end of the container 2.

The length X of the end portion 13 is preferably at least 1 times, more preferably at least 2 times, particularly preferably at least 4 times, the distance A between the latching device 11 and the shoulder 14 or a lower edge of the side wall 8. This is illustrated in particular in FIG. 6.

The end portion 13 is preferably configured to surround the lower part 5 and/or the upper end of the container 2 of the dispenser 1 when the protective cap 4 is attached to the dispensing head 3 and/or the dispenser 1.

Preferably, the end portion 13 corresponds to the lower part 5 and/or the upper end of the container 2, such that when the protective cap 4 is attached to the dispensing head 3 and/or dispenser 1, the end portion 13 abuts on the lower part 5 and/or the upper end of the container 2. Alternatively or additionally, when the protective cap 4 is attached to the dispensing head 3 and/or dispenser 1, the distance between the end portion 13 and the lower part 5 and/or the upper end of the container 2 is less than 2 mm, preferably less than 1 mm. This is conducive to an effective protection against tilting of the protective cap 4.

As explained above, the latching device 11 and/or the latching element(s) 12 is preferably designed to surround/encircle the protective cap 4. In the illustrative example, the detent device 11 does not completely surround/encircle the protective cap 4 or inner surface 8A of the side wall 8, but only over a circumferential angle of at least about 340 and/or at most about 355 degrees. This is illustrated in particular in FIGS. 4 and 8.

In particular, the protective cap 4 comprises a ventilation opening 16.

The ventilation opening 16 is formed in particular by an interruption of the latching device 11 and/or the latching elements 12 and/or a radially outwardly offset portion of the side wall 8 or of its inner surface 8A and/or of the end portion 13 or of its inner surface 13A. In particular, the ventilation opening 16 represents a (local) recess in the end portion 13 or its inner surface 13A and/or in the side wall 8 or its inner surface 8A. The ventilation opening 16 preferably has a greater distance from the central axis L than the side wall 8 or its inner surface 8A and/or the end portion 13 or its inner surface 13A.

The ventilation opening 16 preferably facilitates, on the one hand, an intended detachment or removal of the protective cap 4 from the dispensing head 3 or dispenser 1, since a negative pressure which would otherwise arise when removing the protective cap 4 is avoided. On the other hand, ventilation of the cavity formed or enclosed by the protective cap 4 is ensured, so that pressure equalization between the cavity and the external environment of the dispenser 1 or the protective cap 4 is made possible. This avoids, in particular, an overpressure or underpressure in the cavity caused, for example, by temperature fluctuations, which could lead to damage to the dispenser 1 or dispensing head 3.

Individual aspects and features of the present invention may be implemented independently, but also in any combination.

LIST OF REFERENCE SIGNS

1 Dispenser
2 Container
3 Dispensing head
4 Protective cap
5 Lower part
6 Upper part
7 Actuating section
8 Sidewall
8A Inner surface of 8
9 Open end
10 Closed end
11 Latching device
12 Latching element
13 End portion
13A Inner surface of 13
14 Shoulder
15 Inclined surface
16 Ventilation opening
A Distance 13 and 11
D1 Internal diameter of 8
D2 Internal diameter of 13
F Fluid
U Overlap of 5 and 13
X Length of 13
Y Length of 8
Z Length of 5

The invention claimed is:

1. A protective cap configured for a dispensing head of a dispenser configured for dispensing a fluid, comprising:

the protective cap, wherein the protective cap is attachable to one or more of the dispensing head and the dispenser such that the protective cap surrounds the dispensing head, a side wall and an open end, wherein the side wall defines a cavity for receiving the dispensing head, at the open end, an end portion having an inner surface offset outwardly with respect to the side wall, and a latching device for latchingly attaching the protective cap to one or more of the dispensing head and the dispenser, and a ventilation opening formed by one or more of an interruption of the latching device and a radially outwardly offset portion of the side wall.

2. The protective cap according to claim 1, wherein an anti-tilt device includes the end portion or is formed by said end portion.

3. The protective cap according to claim 1, wherein the end portion has a greater distance from a central axis of the protective cap than the side wall.

4. The protective cap according to claim 1, wherein one or more of the end portion and the side wall is cylindrical, sleeve-like and/or ring-like.

5. The protective cap according to one claim 1, wherein the protective cap has a shoulder between the side wall and the end portion.

6. The protective cap according to claim 1, wherein one or more of:

the end portion adjoins the side wall in the direction of the open end, and the end portion and the side wall are formed in one piece.

7. The protective cap according to claim 1, wherein the length of the end portion is at least 3 mm and/or at most 20 mm.

8. The protective cap according to claim 1, wherein the length of the protective cap is at least 2 times and/or at most 10 times the length of the end portion.

9. The protective cap according to claim 1, wherein the latching device comprises or consists of one or more latching elements, wherein the latching element or the latching elements are each formed by a raised portion and/or latching lug on an inner surface of the protective cap.

10. The protective cap according to claim 1, wherein the length of the end portion is at least one times the distance between the latching device and a lower edge of one or more of the side wall and the shoulder.

11. The protective cap according to claim 1, wherein when the protective cap is attached to one or more of the dispensing head and the dispenser, an overlap between one or more of the end portion and a lower part of the dispensing head and an upper end of the container is at least 3 mm and/or at most 20 mm.

12. The protective cap according to claim 1, wherein said end portion is configured such that the end portion surrounds or engages one or more of a lower part of said dispensing head and an upper end of a container of said dispenser when said protective cap is attached to one or more of the dispensing head and the dispenser.

13. The protective cap according to claim 12, wherein one or more of:

the end portion corresponds to one or more of the lower part of the dispensing head and the upper end of the container, such that when the protective cap is attached to one or more of the dispensing head and the dispenser, the end portion abuts on the lower part of one or more of the dispensing head and the upper end of the container, and a distance between the end portion and the lower part of one or more of the dispensing head and the upper end of the container is less than 2 mm.

14. The protective cap according to claim 1, wherein the protective cap has a latching device for latchingly attaching the protective cap to one or more of the dispensing head and the dispenser and an anti-tilt device configured to prevent tilting of the protective cap, wherein the anti-tilt device is formed by the outwardly offset end portion, wherein the end portion adjoins the side wall in the direction of the open end, wherein the length of the end portion is at least 3 mm, the length of the protective cap is at least 3 times the length of the end portion, and the length of the end portion is at least one times the distance between the latching device and a lower edge of the side wall and/or the shoulder.

15. A system comprising a dispensing head configured for dispensing a fluid and the protective cap according to claim 1 for the dispensing head.

16. The system according to claim 15, wherein a lower part of the dispensing head forms an axial stop for the protective cap.

17. The system according to claim 15, wherein the length of the end portion is at least 50% of the length of a lower part of the dispensing head.

18. A dispenser with a container configured for holding a fluid comprising the system according to claim 15.

* * * * *